US007377683B2

(12) United States Patent
Koegler et al.

(10) Patent No.: US 7,377,683 B2
(45) Date of Patent: May 27, 2008

(54) REFLECTOR

(75) Inventors: John M. Koegler, Corvallis, OR (US); P. Guy Howard, Junction City, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/941,228

(22) Filed: Sep. 14, 2004

(65) Prior Publication Data

US 2006/0056187 A1 Mar. 16, 2006

(51) Int. Cl.
*F21V 7/00* (2006.01)

(52) U.S. Cl. ..... 362/647; 362/343; 359/868

(58) Field of Classification Search ..... 362/341, 362/342, 344, 346, 360, 548, 549, 640, 647, 362/652, 655, 656; 313/113; 359/868, 869, 359/838, 867

See application file for complete search history.

(56) References Cited

U.S. PATENT DOCUMENTS 947,699 A * 1/1910 Nientimp ..... 40/579
1,497,678 A * 6/1924 Godley ..... 362/341
2,117,760 A * 5/1938 Douglas ..... 362/519
2,268,878 A * 1/1942 Kopp ..... 362/341
2,853,595 A * 9/1958 Baldwin ..... 362/485
3,486,019 A * 12/1969 Bryant et al. ..... 362/548
4,974,138 A * 11/1990 Negishi ..... 362/347
5,466,981 A 11/1995 Fields
5,722,758 A * 3/1998 Huang ..... 362/548
5,855,430 A * 1/1999 Coushaine et al. ..... 362/519
6,024,470 A * 2/2000 Wang ..... 362/370
6,036,338 A * 3/2000 Gordin ..... 362/350
6,079,849 A * 6/2000 Baliozian ..... 362/250
6,152,589 A * 11/2000 Kawaguchi et al. ..... 362/518
6,428,198 B1 8/2002 Saccomanno et al.
6,471,356 B1 10/2002 Gohman et al.
6,774,545 B1 8/2004 Zhou
6,827,470 B2 * 12/2004 Sagal et al. ..... 362/341
2002/0018186 A1 2/2002 Sea-Huang et al.
2002/0141193 A1 * 10/2002 Chong ..... 362/308

FOREIGN PATENT DOCUMENTS

DE 9408424 8/1994

OTHER PUBLICATIONS

International Search Report from European Patent Office dated Oct. 21, 2005 (1 pg).

* cited by examiner

*Primary Examiner*—Thomas M. Sember

(57) ABSTRACT

A reflector includes a body having a reflective surface formed therein and a reflector opening defined in the body, the reflector opening having a plurality of ridges.

10 Claims, 7 Drawing Sheets

REFLECTOR

BACKGROUND

Digital projectors, such as digital micro-mirror devices (DMD) and liquid crystal devices (LCD) projectors, project high quality images onto a viewing surface. Both DMD and LCD projectors utilize high intensity burners and reflectors to generate the light needed for projection. Light generated by the burner is concentrated as a 'fireball' that is located at a focal point of a reflector. Light produced by the fireball is directed from the reflector into a projection assembly that produces images and utilizes the generated light to illuminate the image.

The image is then projected onto a viewing surface. Misalignment of the reflector focal point causes degradation of the image since less light is captured and creates 'hot spots' on the screen instead of a uniform brightness. The alignment of the focal point of the fireball with respect to the reflector may depend, at least in part, on the relative alignment between the reflector opening and the reflective surface of the reflector. In conventional devices, once the burner has surpassed its useful life, the entire assembly is typically discarded, including the reflector.

BRIEF DESCRIPTION OF THE DRAWINGS

The accompanying drawings illustrate various embodiments of the present apparatus and method and are a part of the specification. The illustrated embodiments are merely examples of the present apparatus and method and do not limit the scope of the disclosure.

Throughout the drawings, identical reference numbers designate similar, but not necessarily identical, elements.

DETAILED DESCRIPTION

Figure 1:
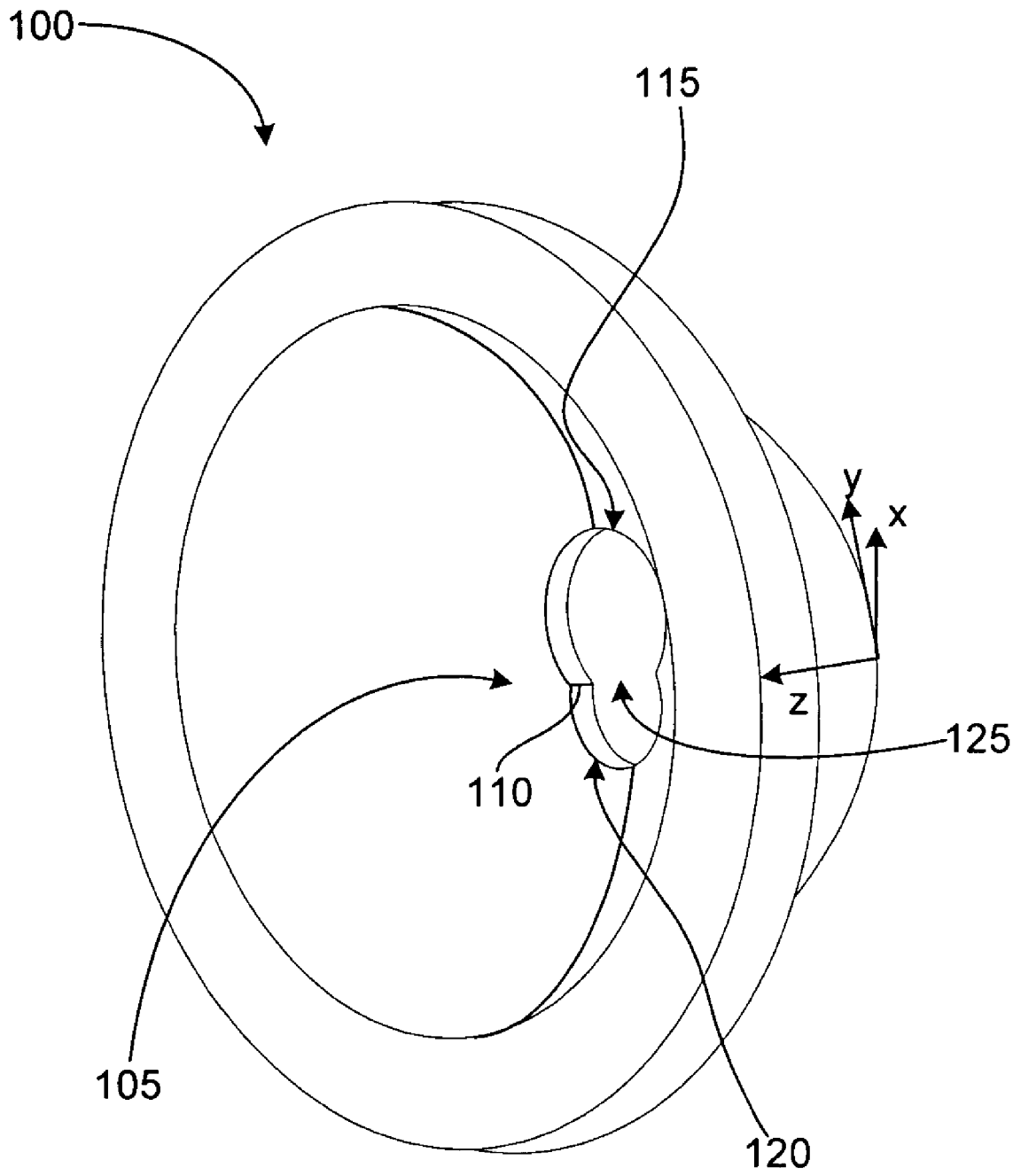
FIG. 1 illustrates a perspective view of exemplary reflector having a datum structure, according to an example embodiment.

FIG. 1 illustrates a perspective view of a reflector (100) having a reflector opening (105) with ridges (110). The term "ridge" shall be broadly understood as any surface formed by two or more converging surfaces. In particular, the reflector opening (105) includes a major cylindrical void (115) and a minor cylindrical void (120). The major cylindrical void (115) and minor cylindrical void (120) overlap. Two distinct ridges (110) are formed by the overlap at the points where the major cylindrical void (115) and the minor cylindrical void (120) intersect. This overlap results in a gap (125) between the ridges (110). As will be discussed in more detail below, the ridges (110) are configured to allow a burner assembly to be aligned with respect to and coupled to the reflector (100). Further, the ridges (110) allow the coupling and alignment to be accomplished without the use of tools.

The reflector (100) may be of any suitable type, including a parabolic or elliptical reflector. In addition, the reflector (100) may be configured to be utilized in a number of systems, including projection or television applications. The reflector opening (105) is an opening defined in the reflector (100). The reflector opening (105) is of sufficient size to allow at least part of a burner to be passed there through. As previously introduced, the reflector opening (105) also includes ridges (110) for aligning a burner with respect to the reflector (100). These ridges (110) are part of a datum structure for accurately and repeatably aligning a burner to a coordinate system.

In addition, the reflector (100) may be formed of a metallic material such as zinc, aluminum, magnesium, brass, copper, alloys thereof or other suitable materials. Such a configuration may allow the reflector (100) to also serve as a heat sink for reducing heat buildup in a light generation assembly.

For ease of reference, the following description is described with reference to an X, Y, and Z coordinate system. Additionally, the present system is described with reference to the origin being at the center of a reflector opening (105) wherein the Z axis represents the direction of insertion.

Figure 2:
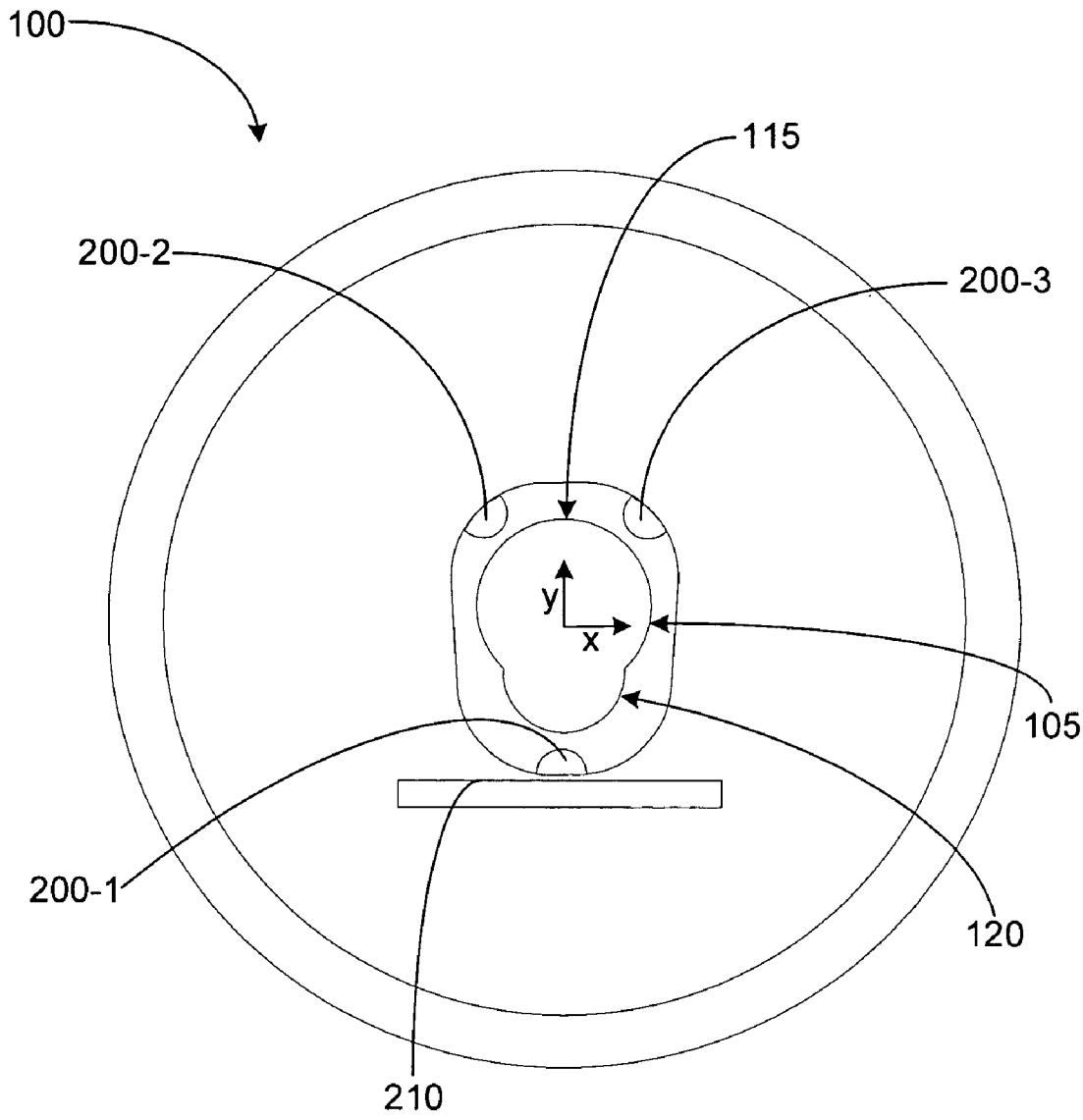
FIG. 2 illustrates a rear view of the exemplary reflector of FIG. 1, according to an example embodiment.

FIG. 2 illustrates a rear view of the reflector (100) of FIG. 1. As shown in FIG. 2, a plurality of alignment surfaces are formed near the reflector opening (105). In the exemplary reflector shown (100), three Z-axis alignment surfaces (200-1, 200-2, 200-3) and a Z-axis rotation surface (210) are shown formed near the reflector opening (105). As will be discussed in more detail below with reference to FIGS. 3-5, these alignment surfaces along with the ridges (110; FIG. 1) allow for the aligned coupling of a burner assembly to the reflector (100).

Also shown in FIG. 2, is the relative positioning of the major and minor cylindrical voids (115, 120) with respect to the coordinate system. In particular, centers of each of the cylindrical voids (115, 120) are offset equally from the center of the reflector (100). For example, in one embodiment, the major cylindrical void (115) is formed with its center 1/16 inch above the center of the reflector (100) and the minor cylindrical void (120) is formed with its center 1/16 inch below the center of the reflector (100). Further, in one embodiment, the major cylindrical void (115) has a diameter of approximately ½ inch while the minor cylindrical void (120) has a diameter of approximately ⅜ inches.

Figure 3:
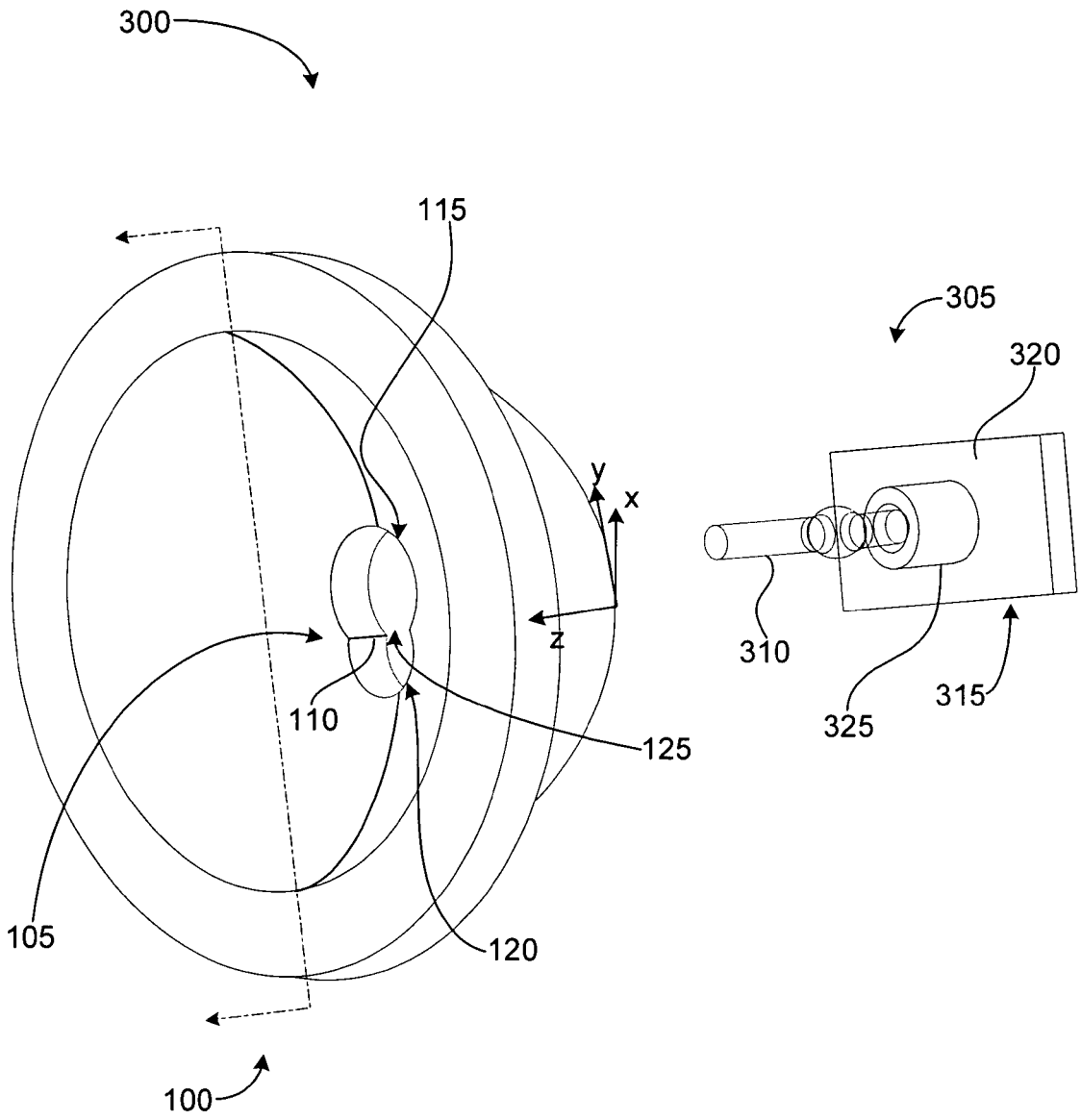
FIG. 3 illustrates an exploded view of an exemplary light generation assembly, according to an example embodiment.

FIG. 3 illustrates an exploded view of a light generation assembly (300) that generally includes a reflector (100) and a burner assembly (305). The burner assembly (305) generally includes a burner (310) coupled to a burner header (315). The burner assembly (305) is configured to be replaceably coupled to the reflector (100).

The burner (310) may be of any suitable type that produces sufficient light, such as for projection and/or television applications. An example of a burner is an ultra-high pressure mercury arc burner. The burner header (315) allows the burner (305) to be coupled to the reflector (100).

The burner header (315) includes a base member (320), and a burner engaging member (325) extending away from the base member (320). The burner engaging member (325) shown is a cylindrical burner engaging member (325). In some embodiments, the circular burner engaging member (325) has an external diameter that is slightly smaller than the diameter of the major cylindrical void (115) of the reflector opening (105). As a result, the burner engaging member (325) is able to pass at least partially through the reflector opening (105).

When the burner assembly (305) is coupled to the reflector (100), the burner engaging member (325) comes into contact with the ridges (110) and the base member (320) comes into contact with the alignment surfaces (200-1, 200-2, 200-3, 210) shown in FIG. 2. This contact between the burner assembly (305) and the reflector (100) constrains the alignment of the burner assembly (305), as will now be discussed in more detail below.

As previously introduced, alignment of the burner assembly (305) with respect to the reflector (100) references an X, Y, and Z coordinate system having its origin at the outside edge of the reflector opening (105), as shown in the figures. Using this coordinate system, the ridges (110) are lines that are substantially parallel to each other and to the Z-axis. In addition, the ridges (110) may extend through the thickness of the reflector opening (105).

Figure 4:
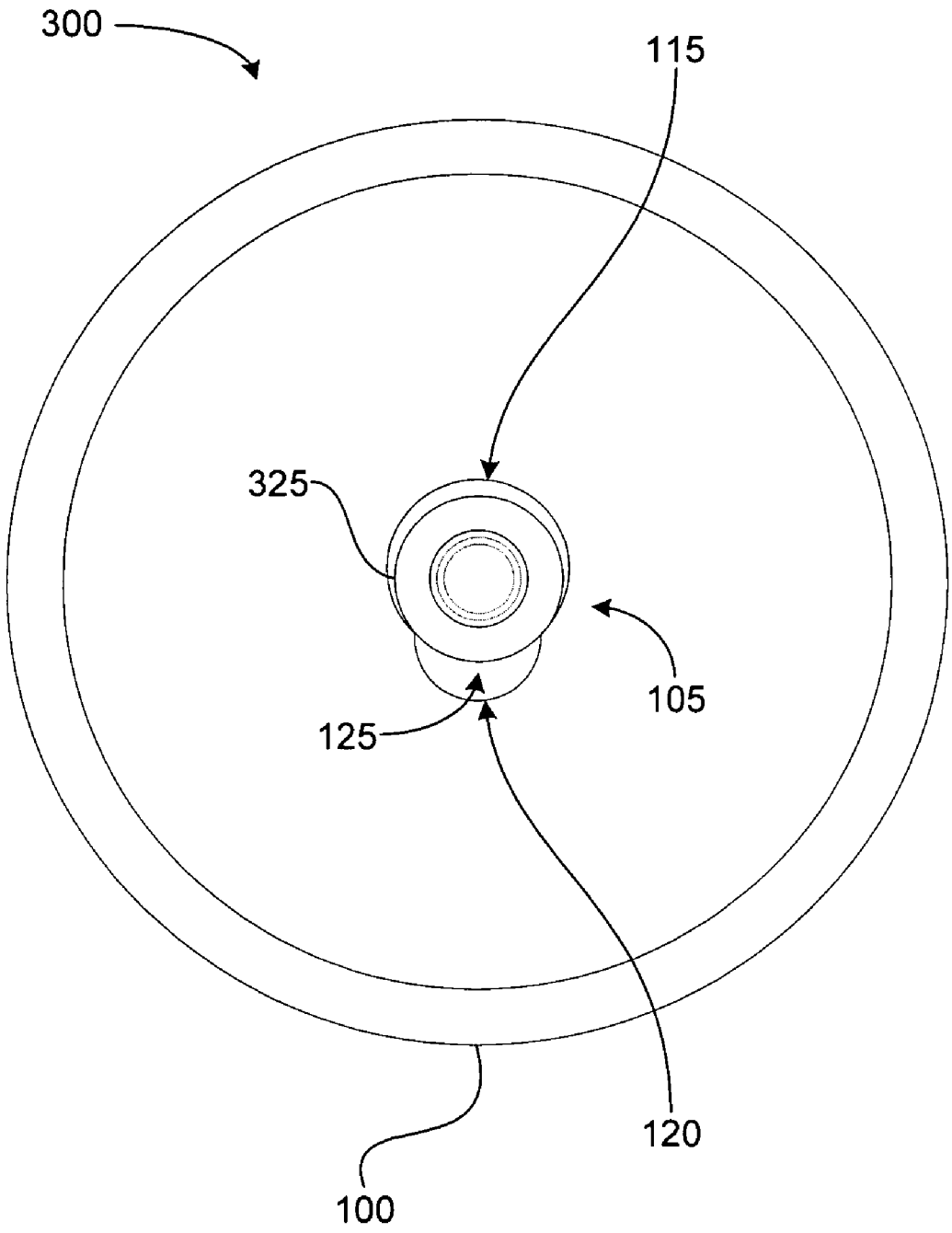
FIG. 4 illustrates a frontal view of the exemplary light generation assembly shown in FIG. 3, according to an example embodiment.

FIG. 4 illustrates a frontal view of the light generation assembly (300) wherein the burner assembly (305; FIG. 3) is coupled to the reflector (100; FIG. 3). When the two assemblies are thus coupled, only a small portion of the burner engaging member (325) comes into contact with the reflector opening (105). In particular, a small portion of the burner engaging member (325) falls outside of the major cylindrical void (115) and into the minor cylindrical void (120) such that a small portion of the burner engaging member (325) falls into the gap (125) between the ridges (110; FIG. 3). This configuration causes the contact that occurs between the burner engaging member (325) and the reflector opening (105) to be limited to contact along the ridges (110; FIG. 3).

The exemplary reflector (100) shown and discussed with reference to FIGS. 1-5 makes use of overlapping cylindrical voids to form the ridges (110; FIG. 3) with a gap there between. Other shapes or configurations may also be used to form such lines and gaps. Limiting the contact between the burner engaging member (325) and the reflector opening (105) to contact along the ridges (110) constrains the location of the burner assembly (305) in the X-Y plane. More specifically, a single plane is defined by two parallel lines. Accordingly, when the burner engaging member (325) is placed in simultaneous contact with the ridges (110), the location and alignment of the burner assembly (100) is thereby constrained to motion in the plane that contains both of the ridges (110).

With respect to the chosen coordinate system, the alignment plane is substantially orthogonal to the X-Y plane. As a result, placing the burner engaging member (325) in simultaneous contact with the ridges (110) constrains the translation and rotation of the burner assembly (305) with respect to the X-axis and the Y-axis. Consequently, such contact constrains four of the six possible degrees of freedom. The two remaining degrees of freedom include rotation about the Z-axis and translation parallel to the Z-axis. Contact between the burner assembly (305) and the alignment surfaces shown in FIG. 2 constrain the alignment and orientation of the burner assembly, as will now be discussed.

Figure 5:
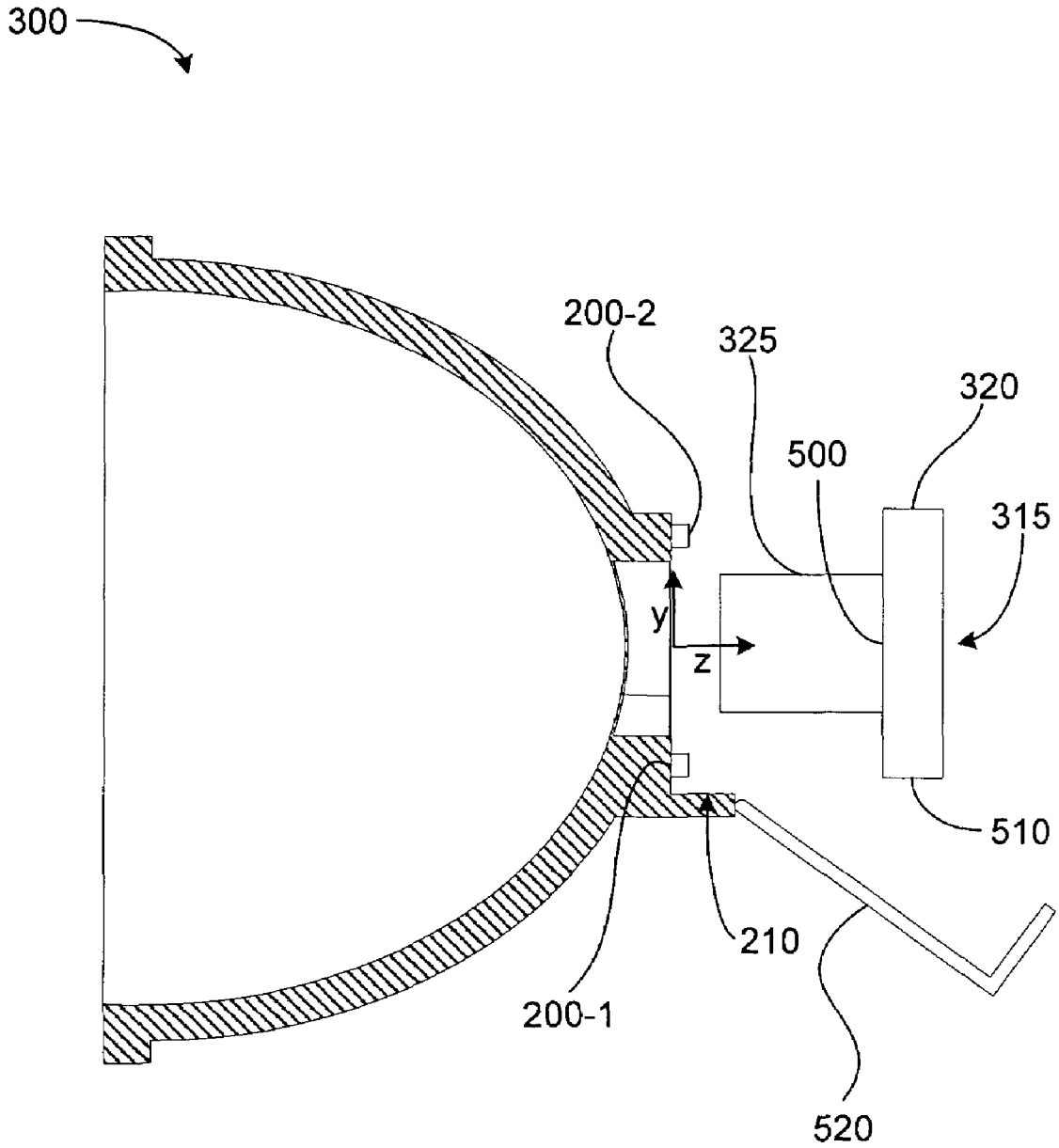
FIG. 5 illustrates sectional view of the exemplary light generation assembly show in FIG. 3 taken with respect to the line C-C in which the burner has been removed from the burner assembly for ease of illustration, according to an example embodiment.

FIG. 5 is a partial exploded cutaway view of the light generation assembly (300) discussed with reference to FIGS. 3 and 4. The burner (310; FIGS. 3-4) has been removed to focus on the interaction between the burner header (315) and the three Z-axis alignment surfaces (200-1, 200-2 shown, 200-3 shown in FIG. 2) and the Z-axis rotation surface (210). The base member (320) includes a Z-axis translation limiting surface (500) and a bottom surface (510). The Z-axis translation limiting surface (500) is a generally planar surface that is configured to be placed in contact with the Z-axis alignment surfaces (200-1, 200-2, 200-3). Further, the Z-axis translation limiting surface (500) is generally normal to the bottom surface (510) and to a center line of the burner engaging member (325). In addition, the rest of the surfaces of the base member (320) are substantially normal to adjacent surfaces.

A single plane is defined by the Z-axis alignment surfaces (200-1, 200-2, 200-3). Accordingly, placing the Z-axis translation limiting surface (500) in contact with the Z-axis alignment surfaces (200-1, 200-2, 200-3) further constrains the orientation of the burner header (315) in the plane defined by the Z-axis alignment surfaces (200-1, 200-2, 200-3). Consequently, this contact constrains the translation of the burner header (315) parallel to the Z axis.

The exemplary reflector (100) shown includes three Z-axis alignment surfaces. This configuration results in an over-constrained alignment of the burner assembly (305) to the reflector (100). The alignment and orientation is over-constrained because rotation about the X and Y axes is constrained by contact between the burner engaging member (325) and the ridges (110) and by contact between the Z-axis translation limiting surface (500) of the base member (320) and the Z-axis alignment surfaces (200-1, 200-2, 200-2). Other reflector assemblies may be formed using any suitable number of Z-axis alignment surfaces.

For example, in some embodiments, a single Z-axis alignment surface may be used to constrain the translation of the burner header (315) parallel to the Z-axis. With such a configuration, rotation of the component about the X and Y axes is constrained by contact between the burner engaging member (325) and the ridges (110), as previously discussed. In many cases, constraint of the five degrees of freedom thus far discussed, namely translation parallel to the X, Y, and Z axes and rotation about the X and Y axes, may be sufficient for proper operation of the light generation assembly (300). In other cases, it may be desirable to further constrain the alignment and orientation of the burner assembly (305) with respect to rotation about the Z axis.

The exemplary reflector (100) shown includes a Z-axis rotation surface (210). The Z-axis rotation surface (210) is configured to have the bottom surface (510) of the base member (320) placed in contact therewith. As previously discussed, if the burner engaging member (325) is in contact with ridges (110) and the Z-axis translation limiting surface (500) is placed in contact with the Z-axis alignment surfaces (200-1, 200-2, 200-3), five of the six degrees of freedom of the alignment and orientation of the burner assembly (305) with respect to the reflector (100) are constrained.

Placing the bottom surface (510) in contact with the Z-axis rotation surface (210) constrains the rotation of the burner assembly (305) about the Z axis. In particular, the Z-axis rotation surface (210) is substantially planar and its orientation and location are substantially fixed relative to the reflector (100). The bottom surface (510) is also substantially planar. Consequently, placing these two surfaces in contact with each other causes the surfaces to be substantially coplanar. Because the orientation and alignment of the Z-axis rotation surface (210) is fixed, the contact between the two surfaces constrains the rotation of the burner assembly (305) about the Z axis.

A Z-axis rotation surface (210) has been shown and described for constraining the rotation of the burner assembly (305) about the Z axis. Other configurations are possible, such as the use of two fixed protrusions or datum pads. In such a case, the two pads would take the place of the Z-axis rotation surface (210). Since any two points define a line, a line would be formed between two such pads. Placing the bottom surface (510) in contact with the reference pads would cause the bottom surface to become substantially collinear with the reference pads, thus constraining the rotation of the burner assembly (305) about the Z-axis. Further, two pads may be formed to contact any of the surfaces, such as the perimeter surfaces, of the base member (320). In addition, biasing members, such as latch (520) may be employed to maintain the burner assembly (305) in aligned contact with the reflector (100). Other biasing members may also be used, such as springs, etc.

Accordingly, the datum structure formed in and around the reflector opening (105) allows for the aligned, oriented, and repeatable coupling of a burner assembly (305) thereto in an aligned orientation. Further, this configuration allows for the burner assembly (305) to be coupled to and removed from the reflector (100) without the use of tools. Consequently, when a burner has surpassed its useful life, the burner assembly (305) alone may be removed and a new burner assembly installed. Further, as will be discussed in more detail below, this configuration permits accurate and repeatable alignment of each burner assembly (305) to the reflector (100).

Figure 6:
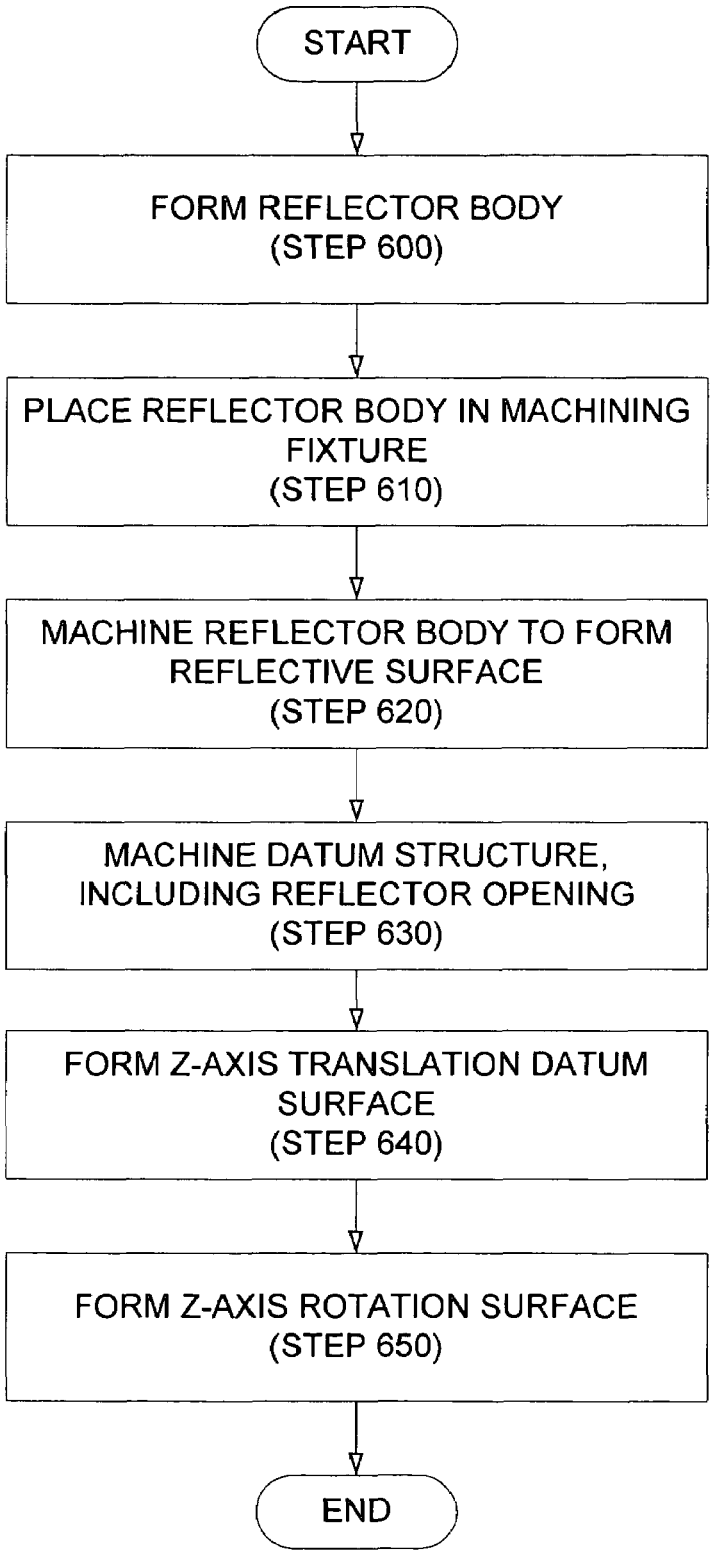
FIG. 6 illustrates an exemplary method of forming a reflector, according to an example embodiment.

FIG. 6 is a flowchart illustrating an exemplary method of forming a reflector. The method shown reduces the number of times the reflector is placed in a machining fixture, which may permit accurate alignment between the datum structure and the reflector.

The method begins by forming a body (step 600). This step may include filling a mold with molten metal in which the mold corresponds to the general finished shape of the reflector. One suitable mold is a die-casting mold that is shaped to form the body. As will be discussed in more detail with reference to FIG. 7, the mold may also be configured to form the cooling fins. The mold is then filled with molten material by forcing the molten material into the mold under pressure, as is the case in die casting operations. The pressure helps to ensure molten material fills all of the cavities in the mold, including those used to form the cooling fins. This molten material may be a metal, such as zinc, aluminum, magnesium, copper, and/or alloys of these metals. The use of the metal to form the integrated unit may allow the integrated unit to dissipate heat more rapidly, as been previously discussed.

Once the body has been formed, the body is then placed in a machining fixture (step 610). Such a fixture may include a standard fixture used with machine tools, such as with milling machines, etc. The machine tool is aligned with respect to the fixture and the body. Accordingly, when the body is placed in the fixture, the machine tool is oriented with respect to that placement. In other words, the coordinate system of the body is re-established each time the body is placed in the fixture.

After the body has been securely placed in the fixture (step 610), the body is machined to form a reflective surface (step 620). The reflective surface (620) may be characterized by a hyperbolic profile, such as an elliptical or parabolic profile. As a result, light that is generated at the focal point of hyperbolic profile is reflected off of the reflective surface and out of the reflector in a controlled manner.

Once the reflective surface has formed in the body (step 620), and while the body remains in the machining fixture, the major and minor cylindrical voids that define the reflector opening and ridges are machined into the body (step 630). Accordingly, the reflector opening and ridges are formed by the machine tool using the same alignment established above for forming the reflective surface.

Alignment errors or inaccuracies associated with re-positioning the body between forming operations are thus reduced or eliminated by not re-positioning between steps. As a result, accuracy of relative location of the focal point of the reflective surface, the ridges, and reflector may be substantially achieved. As previously discussed, the efficiency of a light generation assembly, in some embodiments, may depend at least in part on the alignment of the central portion, or fireball, of a burner with respect to the focal point of the reflector.

Once the reflector opening has been formed, at least one Z-axis translation datum surface is formed on the body (step 640). This surface may be formed by the same machine tools as used to form the reflective surface and reflector opening. Further, a Z-axis rotation surface may be formed (step 650). These surfaces may constrain the alignment and orientation of a burner assembly to a reflector as previously described with reference to FIGS. 3-5.

Accordingly, some embodiments of the present method provide for the formation of a reflector that includes a datum structure for having a burner assembly coupled thereto in an aligned manner. The formation of the datum structure includes the formation of a reflective surface and the formation of overlapping circles that form ridges while the body is in a single position in a machine fixture.

Further, some embodiments of the present method provides for the formation of a reflector that is configured to have a burner assembly removably coupled thereto. This configuration may reduce the cost of operating a light generation system that makes use of such a reflector system. In particular, once a burner assembly that is coupled to the reflector has surpassed its useful life, the burner assembly alone may be replaced rather than replacing the entire light generation assembly.

In addition, the datum structure that is part of the reflector increases the accuracy of the alignment of burner assemblies coupled thereto. As recently discussed, once a burner assembly has surpassed its useful life, that burner assembly may be removed and replaced with a new burner assembly. Further, as previously discussed, the present method provides for increased accuracy in the relative alignment between the focal point of the reflective surface and the ridges in the reflector opening. Consequently, when a new bulb is coupled to the reflector the datum structure allows the central portion or fireball generator of the burner to be substantially aligned with respect to the focal point of the reflective surface. This alignment provides for satisfactory efficiency of a light generation assembly because an adequate portion of the light generated by the burner is directed out of the light generation assembly.

Figure 7:
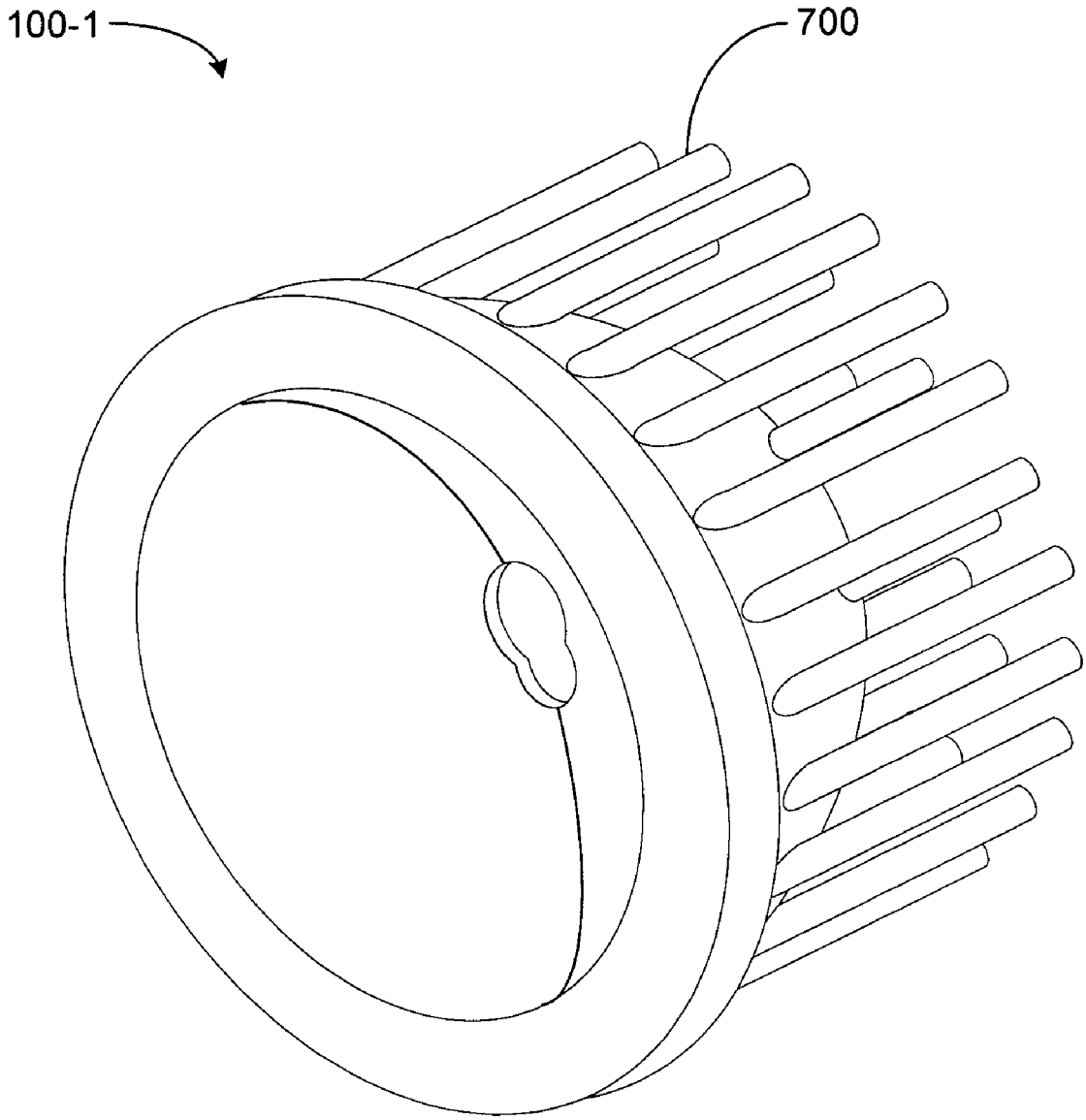
FIG. 7 illustrates a perspective view of an exemplary reflector, according to an example embodiment.

As previously discussed, the reflector may be formed of a metallic material such that the body may also serve as a heat sink. As shown in FIG. 7, the reflector (100-1) may be formed with cooling fins (700). The amount of heat transferred by an object depends, at least in part, on the exposed surface area of the object. The cooling fins (700) increase the heat transfer rate by increasing the exposed surface area of the reflector (100-1). The spacing of the cooling fins (700) helps ensure that as air around one cooling fin is heated, that heated air will not substantially heat air around an adjacent cooling fin, thereby slowing heat transfer. Accordingly, a reflector (100-1) may be formed with cooling fins (700) to increase the amount of heat transferred from the reflector (100-1).

The preceding description has been presented only to illustrate and describe the present method and apparatus. It is not intended to be exhaustive or to limit the disclosure to any precise form disclosed. Many modifications and variations are possible in light of the above teaching. It is intended that the scope of the invention be defined by the following claims.

What is claimed is:

1. A reflector assembly, comprising:

a body having a reflective surface formed therein; and a reflector opening defined in said body, said reflector opening having a plurality of ridges;

wherein said ridges are defined by the intersection of voids corresponding to overlapping shapes, and wherein said shapes include a major cylindrical void and a minor cylindrical void of different sizes;

wherein said body comprises a central axis; and said major cylindrical void is offset above said central axis and said minor cylindrical void is offset below said central axis.

2. The assembly of claim 1, wherein said major axis is offset ½ inch above said central axis and said minor cylindrical void is offset ½ below said central axis.

3. A reflector assembly, comprising:

a body having a reflective surface formed therein; and a reflector opening defined in said body, said reflector opening having a plurality of ridges that run parallel to an optical axis of said reflective surface;

and wherein said ridges are defined by the intersection of voids corresponding to overlapping shapes;

wherein said shapes include a major cylindrical void and a minor cylindrical void, wherein said minor cylindrical void has a diameter smaller than that of said major cylindrical void;

the assembly further comprising:

a burner assembly that includes a burner comprising a fireball generator, said burner being coupled to a burner header;

wherein said burner assembly is configured to be replaceably coupled to said reflector such that a cylindrical portion of said burner header is in contact with said ridges and does not contact other portions of the body; and wherein said ridges are configured to position said fireball generator at a focal point of said reflective surface when said burner header contacts said ridges in said reflector opening.

4. The assembly of claim 3, wherein said major cylindrical void has a diameter of ½ inch and said minor cylindrical void has a diameter of ⅜ inch.

5. The assembly of claim 3, wherein said contact between said burner header and said ridges constrains relative translation between said reflector and said burner assembly with respect to a first and a second direction and constrains a rotation of said reflector about lines parallel to said first direction and said second direction.

6. The assembly of claim 5, wherein said reflector includes a Z-axis translation surface coupled to said reflector opening;

said burner assembly includes a Z-axis translation limiting surface on said base member; and contact between said Z-axis translation surface and said Z-axis translation limiting surface constrains translation of said burner assembly with respect to a third direction, said third direction being orthogonal to said first and said second directions.

7. The assembly of claim 6, wherein said reflector includes a Z-axis rotation surface coupled to said reflector opening and said burner assembly includes a Z-axis rotation limiting surface on said base member and contact between said Z-axis rotation surface and said Z-axis rotation limiting surface constrains rotation of said burner assembly with respect to said reflector with respect to lines parallel to said third direction.

8. The assembly of claim 3, wherein a burner engaging member of said burner header is generally cylindrical.

9. The assembly of claim 3, wherein said ridges are formed by an intersection of overlapping geometrical voids defined in said reflector of different sizes.

10. The assembly of claim 9, wherein said geometrical voids include a major cylindrical void and a minor cylindrical void of different sizes.

* * * * *